United States Patent [19]

Minéry

[11] 4,203,272

[45] May 20, 1980

[54] MECHANISM FOR CLOSING EGG CONTAINERS

[75] Inventor: Aimé Minéry, Hesingue, France

[73] Assignee: Toni Casutt, Zollikon, Switzerland

[21] Appl. No.: 18,798

[22] Filed: Mar. 8, 1979

[30] Foreign Application Priority Data

Mar. 9, 1978 [CH] Switzerland ..... 2559/78

[51] Int. Cl.[2] ..... B65B 7/20

[52] U.S. Cl. ..... 53/374; 53/376; 93/37 EC

[58] Field of Search ..... 53/374, 376, 377; 93/37 EC

[56] References Cited

U.S. PATENT DOCUMENTS

| | | | |
|---|---|---|---|
| 2,685,158 | 8/1954 | VonHaase | 53/376 X |
| 3,350,841 | 11/1967 | McDonald | 53/374 X |

*Primary Examiner*—Travis S. McGehee

*Attorney, Agent, or Firm*—Flynn & Frishauf

[57] ABSTRACT

Rod-like tools mounted on gears so as to be swung together and apart by a reciprocating drive and running across a conveyor intermittently moving loaded egg containers, likewise oriented across the conveyor, are moved together to fold over the top corrugated strips of the upstanding sides of the egg container, as presented to the machine, by 90°, to bring these strips into abuttment. Each corrugated strip is backed by a flat strip and one of the two has tabs which are folded over by 180° and adhesively bonded to the other flat strip. The folding over of the tabs is performed by a set of fingers that move between segments of the first-mentioned folding tools to raise the tabs at an oblique angle, after which push rods bend them over completely. During these operations adhesive is applied to the surfaces to be bonded so that the tabs will hold the container together after the first-mentioned folding tool and the finger and push-rod assembly are moved back out of the way of the transport path of the container so that the containers on the conveyor can proceed to the next station.

8 Claims, 8 Drawing Figures

MECHANISM FOR CLOSING EGG CONTAINERS

Related U.S. Pat. Nos:

| USP | INVENTOR | |
|---|---|---|
| 3,955,744 | Toni Casutt | May 11, 1976 |
| 3,983,680 | Toni Casutt | Oct. 5, 1976 |
| 4,132,346 | Toni Casutt | Jan. 2, 1979 |

This invention concerns a mechanism for mechanically closing egg containers in which eggs have been seated and of which the top members have not yet been folded down and secured. More particularly, the invention concerns machinery for closing egg containers of the kind made up of a number of corrugated strips of cardboard or similar sheet material in which the corrugations are of the size suitable for holding eggs, the several strips being joined one to another laterally at the flat apex of each corrugation, with a scored or indented folding line being provided at each such joint, so that the strip assembly can first be folded up U-shape about the middle strip for seating the eggs and then the two strips at the top of the legs of the U can then be folded inward to provide the top of the egg container, forming a butt joint where they meet.

One form of such containers is provided with flat strips joined by adhesive to the bottoms of the corrugations. These flat strips form smooth sides and top surfaces of the container, and in a particular variety of containers one of the flat strips which is folded over with its corrugated strip to make half of the top has tab extending outward (and downward before folding), which are intended to be bent completely over on top of both flat strips, bridging the butt joint between them, and cemented there in place to hold the cover closed.

The corrugated strips joined at their apices across folding lines can be made, as is known, from a single sheet by appropriate slitting. A number of kinds of egg containers utilizing such corrugated strips are now known as, for example, those disclosed in U.S. Pat. Nos. 3,955,744, 3,983,680, and 4,132,346—the last-mentioned of which shows a structure particularly suited for handling in the machine of the present invention.

It has heretofore been difficult to close such egg containers mechanically after the eggs have been loaded into place therein. One difficulty in this regard is that only a short stretch of time is available for this operation because a relatively short cycle time is provided, that being all that is needed for the operations at the preceding and following stations is an egg-packing line utilizing a sequence of mechanisms linked by a conveyor. Another problem exists in that only small forces may be applied because the eggs placed in the containers are sensitive to pressure.

THE PRESENT INVENTION

It is an object of the present invention to provide machinery for mechanically closing filled egg containers in a short cycle in step with other operations of preliminary folding of the carton, loading in of the eggs, and so on, in which forces are applied which will spare the contained eggs any exposure to substantial pressure.

In the machine of the present invention, the conveyor carries the egg containers in a direction perpendicular to their length, which is to say that the egg containers are oriented across the conveyor. The containers arrive at the container-closing station folded up in U-shape, with the middle strip of the container resting on the conveyor and with the eggs already loaded into the cavities provided by the corrugations. A pair of bending tools located above the conveyor extend transversely to the direction of the conveyor movement and are arranged to be swung on shafts that are likewise set across the conveyor, which is to say, parallel to the length of the strips which make up the containers advanced on the conveyor.

Means are provided for driving the tools in swinging motion on their respective shafts in opposite directions. These means and shafts are so disposed that the resulting circular arc path of the tools intersects the location, in the case of each tool, of a portion of the egg container that is to be folded over to make the top. The driving means causes the tools to move together to fold over toward each other the portions of the container providing closure at the desired butt joint, and then causes the tools to swing out of the path of transport of the containers, in order to allow the next container to be conveyed by the intermittent motion of the conveyor to the position suitable for the closing operation.

The tools are preferably in the form of rods parallel to the shafts on which they swing, fixed at least at one end on a pair of spur gears that provide, by their engagement, for the opposite directions of movement for the respective tools. Preferably, one of the tool rods is provided in the form of an interrupted rod with the segments supported by members running essentially radially with regard to the axis of the tool movement on each side of the gaps separating adjacent segments. In this case, it is desirable that the shaft about which the tool revolves should be constituted by mere stub shafts journalled at each end of the tool and gear assembly and each carrying one of the spur gears mentioned above.

As a further development of the invention, push-rods having movements coordinated with that of the tools already mentioned and mounted in appropriate support fingers located at places facing the position of the locking tabs are provided for folding over the tabs to a position where they can be held in place by an adhesive.

The invention is further described by way of illustrative example with reference to the annexed diagrammatic drawings in which.

In order that the machine of the present invention may be understood, it is first necessary to describe a typical egg container of the kind to be closed by the particular machine illustrated.

Figure 1:
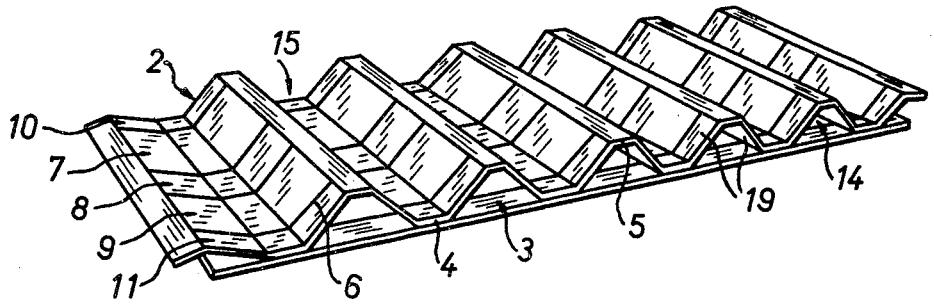
FIG. 1 is a perspective view of an unfolded egg container in the form in which it may be stacked for storage while awaiting use.

As shown in FIG. 1, the container is made, basically, of two parts joined together, namely, a corrugated strip 2 and a flat strip 3. Both strips 2 and 3 are preferably made of cardboard, or material similar to cardboard, of a thickness of about 0.5 mm, which may be indented and printed. The flat region 4 of the bottoms of the corrugations is, in each case, firmly joined by an adhesive to the flat strip 3. Between the flat strip 3 and the two oblique surfaces 19 of each corrugation of the corrugation strip 2, there is provided a cavity 14. The wavelength (i.e., the spacing from one corrugation mid-bottom to the next) corresponds to the center-to-center spacing of the eggs, and preferably amounts to about 4.5 cm.

Figure 2:
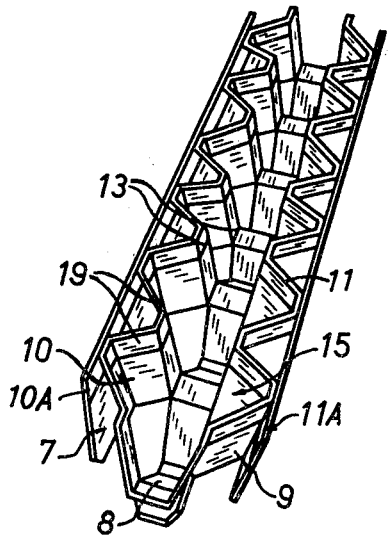
FIG. 2 is a perspective view of the egg container of FIG. 1 after the outer corrugation strips have been folded upward about the middle strip.

Both the corrugation strip 2 and the flat strip 3 are slitted by parallel and longitudinally directed cuts 6, those in the flat strip 3 completely separating that strip into adjacent narrow substrips, while the slits in the corrugation strip 2 terminate just below the flat corrugation tops (apices) 5. This construction produces five adjacent corrugation strips 7, 8, 9, 10 and 11 running parallel to each other, which are joined together only at the corrugation apices 5 at places where indented or scored folding lines 13 are provided (as shown in FIG. 2, but omitted in FIG. 1 to avoid confusion with the slits 6).

The middle corrugation strip 8 is narrower than the neighboring corrugation strips 7 and 9 arranged on one side and the other of the middle strip. The two outer corrugation strips 10 and 11, which may be referred to as the "terminal" strips to avoid confusion with the outer and end portions of the completed container, are about one-half the width of the strip 8. The total of their widths approximates the width of the middle corrugation 8.

In a first step of the setting up of the container, which can conveniently be performed by known machinery being no part of the present invention which is, therefore, not shown, the corrugation strips 7 and 9 are bent up about the folding lines 13 running parallel to the length dimension of the container at the boundaries of the corrugation strip 8 where it is joined to the strips 7 and 8. This forms a structure of more or less U-shaped cross-section, as shown in FIG. 2. This partial setting up of the container is produced on an intermittently driven conveyor belt, upon which the containers remain until they are closed by the machinery of the present invention that is described below.

Figure 3:
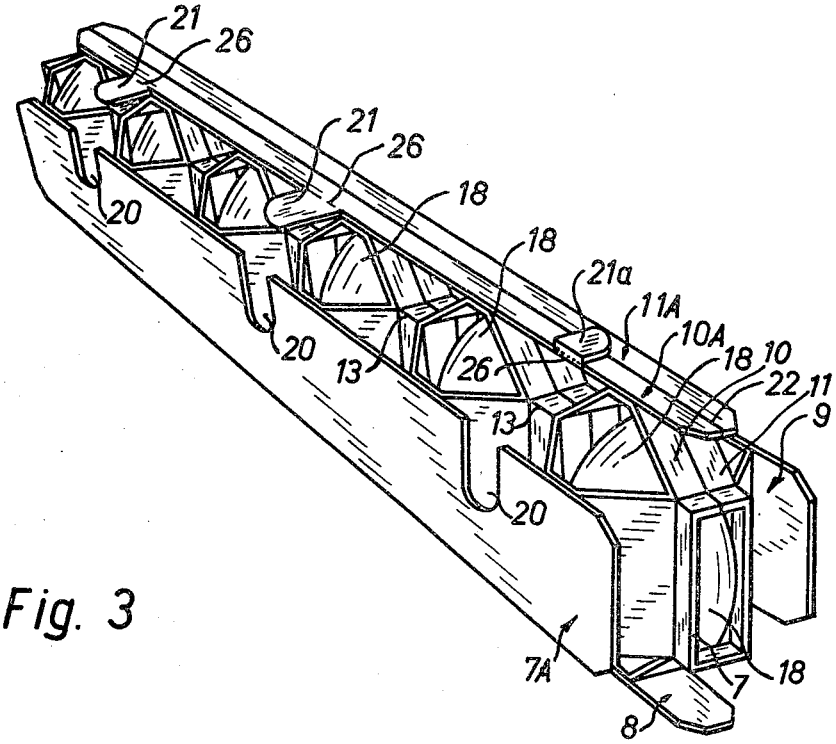
FIG. 3 is a perspective view container filled with eggs and held in its closed condition by only one of its three tabs.
Figure 4:
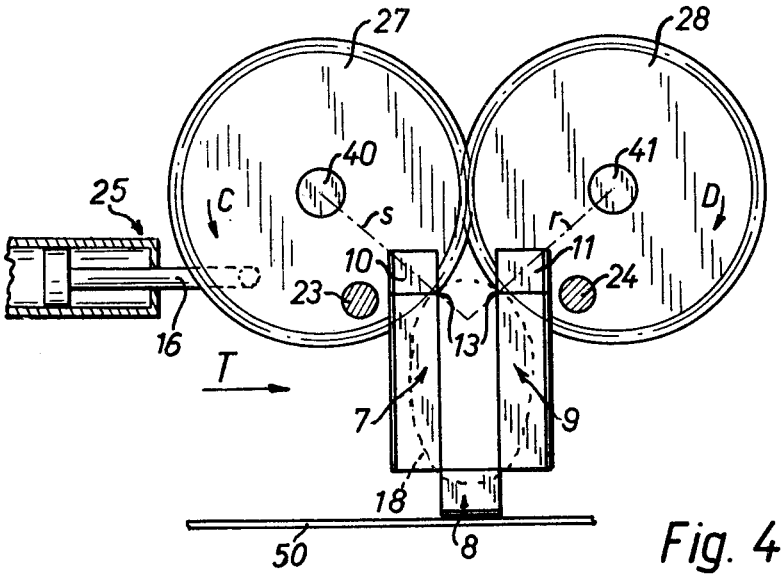
FIG. 4 is a diagrammatic cross-section of the machine of the invention in the position thereof preceding the bending over of the two top strips.

The direction of transport T (in FIG. 4) is perpendicular to the longitudinal direction of the container. In the partly set up container shown in FIG. 2, the eggs 18 (shown in FIG. 3) are loaded into the corrugation valleys 15. Thereafter, the two narrow "terminal" corrugation strips 10 and 11 are folded around corresponding folding lines 13, by about 90° relative to the strips 7 and 9 to which they are attached, this being performed by the mechanism described below, so that finally a container is produced essentially as shown in FIG. 3. The eggs 18 are, thus, held on four sides and surrounded by the corrugation strips 7–11. The surrounding air, nevertheless, has access to the eggs, which is of significance for storing eggs and keeping them fresh. Since the corrugations are somewhat elastic, the eggs packed in such a container are protected against mechanical shock.

In order to hold the container together after filling and closing, a number of tabs 21, for example three in the illustrated case, are provided at least on one of the terminal or outer corrugation strips which forms part of the top of the container. These tabs 21 are stamped out of the material of adjacent wider flat strip 7*a* which is cemented to the adjacent corrugation strip 7—this stamping being part of the slitting operation that separates the flat strips, which may be regarded as a deviation of the slit in question.

As shown in FIG. 3, the tabs 21 stick out away from the flat strip 10A. The length of these tabs 21 is greater than the width of the strip 10A, preferably about twice as long as that width, and are provided with an indented folding line 26 at the root of the tab running parallel to the longitudinal direction of the container, about which the tab can be bent back and bonded to the flat strip 11A which is adjacent across the butt joint 22. The tabs 21, bent over as shown in 21*a* and FIG. 3, thus stretch across the butt joint 22 and, by means of a adhesive, hold the set-up enclosed container together. The tabs 21 may be made integral either with the flat strip 10A or the flat strip 11A. As shown in the illustrated case, in FIG. 3, after the stamping out of the tabs 21 as integral parts of the strip 10, corresponding openings 20 remain in the flat strip 7A that is cemented to the corrugation strip 7.

In order that the places at which the corrugation strip 2 is adhesively joined to the flat strip 3 (FIG. 1) should not be weakened, the openings 20 are in each case provided opposite one of the corrugation apices 5. After the bending over of the two outer or terminal corrugation strips 10 and 11, along with their flat strips 10A and 11A, the tabs 21 lie in the plane of the two flat strips 10A and 11A.

THE MACHINE OF THE PRESENT INVENTION

FIGS. 4–8 describe a mechanism for closing an egg container in accordance with the present invention. As can be seen from FIGS. 4 and 5, the two terminal strips 10 and 11 of an egg container standing up in the form shown in FIG. 2, but filled with eggs, on a conveyor belt 50, are arranged to be simultaneously folded over about the folding lines 13, respectively, by tool members 23, 24. These tools 23, 24 are fastened on each end to a spur gear of an engaged pair of spur gears 27, 28, which provide for equal and opposite motion of the tools 23 and 24.

Shafts 40 and 41, which are the axles of the wheels 27, 28 are so disposed that the imaginary lines r and s running from the shaft centers to the folding lines 13 meet at approximately a right angle.

Figure 5:
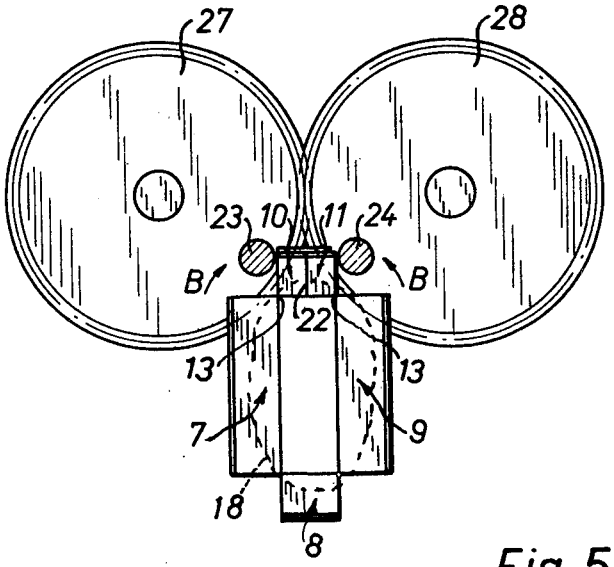
FIG. 5 is a cross-sectional view of a major portion of the machine of FIG. 4 showing its position of the bending over of the two top strips.

The axle shafts 40 and 41 run at right angles to the transport direction T of the container and the supporting conveyor 50. As the gears 27 and 28 are rotated by a drive 25 in the direction of the arrows C and D, they come to lie against the two upper corrugation strip units 10 and 11, then bend these over the fold lines 13 at an angle of about 90°, so the corrugation strips 10 and 11 in their final position lie against each other to form a butt joint as shown in FIG. 5. In this position, the gears 27 and 28 stop and dwell, as do also, of course, the folding tools 23 and 24. The rotation of the gears 27 and 28 and thereby of the longitudinal bending tools 23 and 24 is produced by a pneumatic or hydraulic reciprocating drive 25 which is connected to one of the gears, in the illustrated case to the gear 27 shown in FIG. 4, by a connecting rod 16.

Figure 8:
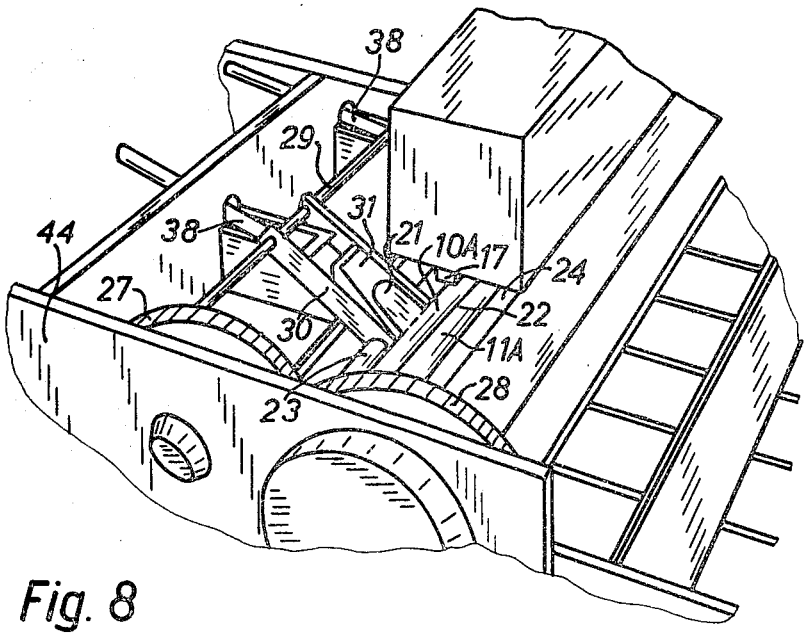
FIG. 8 is a perspective view of a portion of the machine of the preceding Figures showing the folding over devices as well as the folding tools shown in FIGS. 4 and 5.
Figure 7:
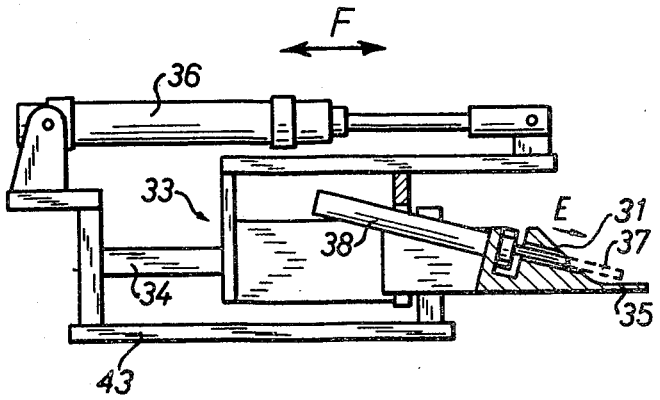
FIG. 7 is a side view, partly in section, of a bending-over apparatus for one of the tabs of the container, showing a sliding carriage mount.

After the gears stop, the tabs 21 are bent up so that they can thereafter be folded over about their folding lines 26 (FIG. 3). For this purpose, finger 35 that is shiftable forward and back is provided for each of the tabs 21 of a container. These fingers are mounted as shown in FIG. 7 on a shiftable sliding carriage 33 for displacement in either direction of the double arrow F. This carriage 33 rides on guide rods 34 or equivalent guide rails and can be moved by a hydraulic or pneumatic piston drive unit 36, so that after the container has been put in the position shown in FIG. 5, the fingers 35 can be pushed forward and thereby brought to lie under the tabs 21. After the simultaneous pushing forward of the fingers mounted on the carriage 33, the tabs 21 extending from the flat strip 10A take an oblique position at an angle of about 30° to 50° prescribed by the oblique surface 31 of the finger, as is shown in FIG. 8.

In order that the tabs 21 may then be completely bent over the butt joint 22 of the two flat strips 10A and 11A, a push-rod 37 which is movable back and forth is provided for each finger 35 and is connected with a reciprocating drive 38. In the supply of compressed air or of oil under pressure, the push-rods 37 can be moved in the direction of the arrow E (FIG. 7) so as to engage the tabs 21 already bent up by the fingers 35 and then fold them over so far that the tabs 21 are brought to lie against the top of the flat strip 11A.

Before the bending over of the tabs 21, an adhesive is sprayed through a nozzle 17 either on what is to become the inner side of the tabs 21, or else on the surfaces of the strip 11A that are to be covered by the tabs. Thus, after the complete bending over of the tabs 21 about the folding lines 26, adhesive bonds are produced which hold the container together in the set-up position shown in FIG. 3. In FIG. 3 only one of the tabs 21A is shown folded over for better understanding of the illustration, but in actuality, of course, all tabs 21 are simultaneously folded over by 80° so that they extend over the butt joint 22 which they secure.

Figure 6:
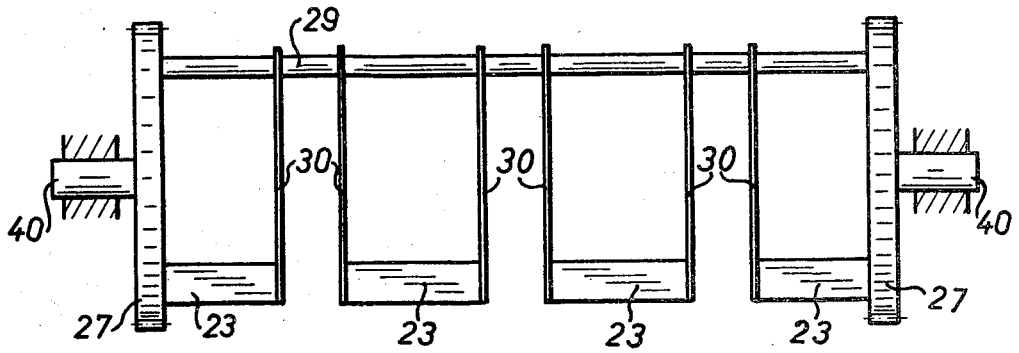
FIG. 6 is a plan view of one of the bending tools of the machine of FIGS. 4 and 5.

In order that the fingers 35, on the one hand, and the tool 23 should not mutually interfere in their movements, the rod which constitutes the tool 23 is not made continuous but is, instead, interrupted where the fingers 35 are present, as shown in FIG. 6, so that it consists of a number of aligned segments. The support of the individual rod segments is provided by a second parallel rod 29 supported on the gears 27 running from one gear to the other, carrying cross-member supports 30 between which the fingers 35 with their push-rods 37 can be introduced and perform their operations.

The complete assembly of the mechanism of FIG. 7 is seated by means of the base plate 43 in the machine frame 44 shown in FIG. 8.

After the tabs 21 are folded over and bonded by adhesive to the strip 11A, the two folding tools 23 and 24 mounted on the gears 27, 28 are swung back again by the reciprocating drive 25 to their initial position. In this movement, the gears 27 and 28 are rotated in the reverse direction, which is to say directions opposite those of the arrows C and D, and at the same time the push-rods 37, the fingers 35 and the sliding carriage 33, as well as the holding tools 23 and 24 are moved out of the path of transport of the container. Then the already closed container will be carried forward in the cycle of intermittent movement of the conveyor in the direction of the arrow T, at right angles to the longitudinal dimension of the container, after which it will be pushed out of the assembly line and off the conveyor.

Although the invention has been described with reference to a particular illustrative example, it will be understood that modifications and variations are possible within the inventive concept.

I claim:

1. A machine for mechanically closing egg containers made of foldable sheet materials having scored folding lines, after eggs have been inserted in the container, for use with egg containers of the kind having a plurality of corrugation strips for nesting eggs between apices thereof in a linear array, each of said corrugation strips being joined to a flat strip at the bottoms of the corrugations and connected, laterally of the egg array, to each other at their said apices across folding lines allowing adjacent corrugation strips to envelop eggs deposited in the bottoms of the corrugations of the middle corrugation strip, there being in addition to said middle srip, two intermediate strips adjacent thereto and two terminal strips respectively adjacent to said intermediate strips, the terminal strips each having about half the width of said middle strip and being intended to be folded around towards each other and joined together edge-to-edge above the contained eggs to close said container, said machine comprising:

means for conveying said egg containers, when the container is folded into U-shape with the said middle corrugation strip at the bottom of the U, in a direction of transport perpendicular to the length of said strips and of said containers;

a pair of bending tools (23, 24) for bending or folding said sheet material, said tools being respectively mounted pivotally on shafts (40, 41) parallel to the length of said strips; and means (25, 27, 28) for driving said tools about said respective shafts in opposite directions in a circular arc path intersecting the location of the upstanding terminal strips of said container prefolded in said U-shape, when the container is on said conveyor at a location which is intermediate of the rest position of said tools, so as to cause said tools by moving towards each other to fold said terminal strips of the container towards and against each other and thereafter to cause said tools to move out of the path of transport of said containers in order to allow another of said containers to be conveyed to said location.

2. A machine for closing egg containers as defined in claim 1, in which said tools (23, 24) are in the form of rods parallel to said shafts (40, 41) and fixed, respectively, on at least one pair of spur gears (27, 28) which are in engagement with each other.

3. A machine for closing egg containers as defined in claim 2, in which said gears (27, 28) are connected to a drive mechanism operated by control means for producing partial revolutions of said gears of predetermined extent in their two directions of rotation, back and forth in timed sequence.

4. A machine for closing egg containers as defined in claim 1, for use with egg containers in which the flat strip (10A) joined to one of said terminal corrugated strips (10) is provided with tabs (21) extending away from the edge of said flat strip which is opposite to the edge thereof which is to be joined with the flat strip (11A) joined to the other of said terminal corrugation strips (11), and in which said machine includes means (33, 35, 37) for folding said tabs up and back over the flat strip (10A) in which they are rooted, so as to overlie also the flat strip (11A) which is adjacent thereto as the result of the operation of said tools and driving means and to bridge the butt joint (22) of said adjacent flat strips.

5. A machine for closing egg containers as defined in claim 4, in which said up-and-over folding means (35, 37) comprise fingers (35) arranged to grip under said tabs (21) in order to fold said tabs (21) up and also comprise push rods (37) movably independent of said fingers (35) for folding over said tabs (21) into their final positions.

6. A machine for closing egg containers as defined in claim 5, in which said fingers (35) and push rods (37) are mounted on a carriage (33) movable back and forth in a straight line, and means (36) are provided for moving said carriage back and forth in a predetermined sequence of movements.

7. A machine for closing egg containers as defined in claim 4, in which two pairs of engaged spur gears (27, 28) are provided for holding said rod-shaped tools, each of said tools running from one gear of one pair to the corresponding gear of the other pair, and in which one of said tools is in the form of an interrupted rod (23) of which the segments are kept in alignment by radially oriented supports (30), so that portions (35, 37) of said up-and-over folding means (33,35,37) may operate in the gaps between said segments.

8. A machine for mechanically closing egg containers comprising:

means for conveying said egg containers, when the container is folded into U-shape with a middle corrugation strip at the bottom of the U, in a direction of transport perpendicular to the length of said strips and of said containers;

a pair of bending tools (23, 24) for bending or folding said sheet material, said tools being respectively movably parallel to the length of said strips; and means (25, 27, 28) for driving said tools in a direction intersecting the location of the upstanding terminal strips of said container prefolded in said U-shape, when the container is on said conveyor at a location which is intermediate of the rest position of said tools, so as to cause said tools by moving towards each other to fold said terminal strips of the container towards and against each other and thereafter to cause said tools to move out of the path of transport of said containers in order to allow another of said containers to be conveyed to said location.

* * * * *